US009457209B2

(12) United States Patent
Piegari et al.

(10) Patent No.: US 9,457,209 B2
(45) Date of Patent: Oct. 4, 2016

(54) FIRE PREVENTION SYSTEMS AND METHODS

(71) Applicant: Optimal Fire Prevention Systems LLC, Rahway, NJ (US)

(72) Inventors: William A Piegari, Westfield, NJ (US); Mel Appelbaum, Morristown, NJ (US)

(73) Assignee: Optimal Fire Prevention Systems, LLC, Rahway, NJ (US)

( * ) Notice: Subject to any disclaimer, the term of this patent is extended or adjusted under 35 U.S.C. 154(b) by 206 days.

(21) Appl. No.: 13/841,448

(22) Filed: Mar. 15, 2013

(65) Prior Publication Data

US 2013/0312984 A1 Nov. 28, 2013

Related U.S. Application Data

(60) Provisional application No. 61/650,940, filed on May 23, 2012.

(51) Int. Cl.

| | |
|---|---|
| ***A62C 2/00*** | (2006.01) |
| ***A62C 3/00*** | (2006.01) |
| ***A62C 99/00*** | (2010.01) |

(52) U.S. Cl.
CPC . *A62C 2/00* (2013.01); *A62C 3/00* (2013.01); *A62C 99/0018* (2013.01)

(58) Field of Classification Search
CPC ..... A62C 3/00; A62C 3/002; A62C 3/0207; A62C 99/009
USPC ..... 169/43, 45, 5, 9
See application file for complete search history.

(56) References Cited

U.S. PATENT DOCUMENTS

| | | | | |
|---|---|---|---|---|
| 6,334,315 | B1 * | 1/2002 | Kotliar | 62/78 |
| 2005/0115722 | A1 * | 6/2005 | Lund et al. | 169/5 |
| 2005/0263298 | A1 * | 12/2005 | Kotliar | 169/45 |
| 2009/0038810 | A1 * | 2/2009 | Wagner | 169/45 |
| 2012/0145417 | A1 * | 6/2012 | Anselm et al. | 169/45 |

* cited by examiner

*Primary Examiner* — Davis Hwu
(74) *Attorney, Agent, or Firm* — Kumar K. Maheshwari; Mahesh Law Group

(57) ABSTRACT

A system or method that has an air distribution system configured to provide nitrogen into a room to reduce an oxygen concentration level within the room below a desired oxygen concentration level such that the atmosphere in the room fails to provide sufficient oxygen to sustain combustion.

21 Claims, 13 Drawing Sheets

1000

| | A | B | C | D | E | F | G | H | I | J | K | L | M | N | O | P |
|---|---|---|---|---|---|---|---|---|---|---|---|---|---|---|---|---|
| 1 | **Optimal FPS Testing** 5/04/2012 | | | | | | | | | | | | | | | |
| 2 | **Optimal Test 1a** | | | | | | **Optimal Test 1b** | | | | | | **Optimal Test 1c** | | | |
| 3 | Time | RM O2 | N2 GEN O2 | AIR COMP/s | N2 VLV/s | | Time | ROOM TEMP | RM HUMIDITY | UNIT HTR 1/ ZTEMP | OUTSIDE TEMP | | Time | SAFTY ALARM | ZONE ALARM | PWR VDC/s |
| 4 | 5/4/12 8:14 AM | | | 0 | 0 | | 5/4/12 8:20 AM | 69.8125 | 44.125 | | | | 5/4/12 8:22 AM | | | 24.125 |
| 5 | 5/4/12 8:14 AM | | | 0 | 0 | | 5/4/12 8:24 AM | | | 71.8125 | 51 | | 5/4/12 8:22 AM | | | 24.125 |
| 6 | 5/4/12 8:14 AM | | | 0 | 0 | | 5/4/12 8:25 AM | 70 | 43.125 | | | | 5/4/12 8:23 AM | | | 24.125 |
| 7 | 5/4/12 8:15 AM | 20.875 | 5 | 0 | 0 | | 5/4/12 8:30 AM | 70 | 43.125 | 71.125 | 51 | | 5/4/12 8:23 AM | | | 24.125 |
| 8 | 5/4/12 8:15 AM | | | 0 | 0 | | 5/4/12 8:35 AM | 70 | 43.125 | | | | 5/4/12 8:23 AM | | | 24.125 |
| 9 | 5/4/12 8:15 AM | | | 0 | 0 | | 5/4/12 8:36 AM | | | 70.75 | 52 | | 5/4/12 8:23 AM | | | 24.125 |
| 10 | 5/4/12 8:15 AM | | | 0 | 0 | | 5/4/12 8:40 AM | 69.8125 | 43.625 | | | | 5/4/12 8:23 AM | | | 24.125 |
| 11 | 5/4/12 8:16 AM | | | 0 | 0 | | 5/4/12 8:42 AM | | | 70.4375 | 52 | | 5/4/12 8:23 AM | | | 24.125 |
| 12 | 5/4/12 8:16 AM | | | 0 | 0 | | 5/4/12 8:45 AM | 69.8125 | 43.625 | | | | 5/4/12 8:23 AM | | | 24.125 |
| 13 | 5/4/12 8:16 AM | | | 0 | 0 | | 5/4/12 8:48 AM | | | 70.1875 | 52 | | 5/4/12 8:23 AM | | | 24.125 |
| 14 | 5/4/12 8:16 AM | | | 0 | 0 | | 5/4/12 8:50 AM | 69.8125 | 44.625 | | | | 5/4/12 8:23 AM | | | 24.125 |
| 15 | 5/4/12 8:17 AM | | | 0 | 0 | | 5/4/12 8:54 AM | | | 69.9375 | 52 | | 5/4/12 8:23 AM | | | 24.125 |
| 16 | 5/4/12 8:17 AM | | | 0 | 0 | | 5/4/12 8:55 AM | 69.6875 | 45.125 | | | | 5/4/12 8:23 AM | | | 24.125 |
| 17 | 5/4/12 8:17 AM | | | 0 | 0 | | 5/4/12 9:00 AM | 69.8125 | 41.625 | 71.1875 | 52 | | 5/4/12 8:23 AM | | | 24.125 |
| 18 | 5/4/12 8:17 AM | | | 0 | 0 | | 5/4/12 9:05 AM | 69.8125 | 42.125 | | | | 5/4/12 8:24 AM | | | 24.125 |
| 19 | 5/4/12 8:18 AM | | | 0 | 0 | | 5/4/12 9:06 AM | | | 70.5625 | 52 | | 5/4/12 8:24 AM | | | 24.125 |
| 20 | 5/4/12 8:18 AM | | | 0 | 0 | | 5/4/12 9:10 AM | 69.8125 | 44.625 | | | | 5/4/12 8:24 AM | | | 24.125 |
| 21 | 5/4/12 8:18 AM | | | 0 | 0 | | 5/4/12 9:12 AM | | | 70.125 | 52 | | 5/4/12 8:24 AM | | | 24.125 |
| 22 | 5/4/12 8:18 AM | | | 0 | 0 | | 5/4/12 9:15 AM | 69.8125 | 46.125 | | | | 5/4/12 8:24 AM | | | 24.125 |
| 23 | 5/4/12 8:19 AM | | | 0 | 0 | | 5/4/12 9:18 AM | | | 69.9375 | 52 | | 5/4/12 8:24 AM | | | 24.125 |
| 24 | 5/4/12 8:19 AM | | | 0 | 0 | | 5/4/12 9:20 AM | 69.8125 | 42.625 | | | | 5/4/12 8:24 AM | | | 24.125 |
| 25 | 5/4/12 8:19 AM | | | 0 | 0 | | 5/4/12 9:24 AM | | | 72.0625 | 52 | | 5/4/12 8:24 AM | | | 24.125 |
| 26 | 5/4/12 8:19 AM | | | 0 | 0 | | 5/4/12 9:25 AM | 70 | 42.125 | | | | 5/4/12 8:24 AM | | | 24.125 |
| 27 | 5/4/12 8:20 AM | 20.8125 | 5.5 | 0 | 0 | | 5/4/12 9:30 AM | 70.3125 | 42.125 | 72.5625 | 53 | | 5/4/12 8:24 AM | | | 24.125 |
| 28 | 5/4/12 8:20 AM | | | 0 | 0 | | 5/4/12 9:35 AM | 70.4375 | 42.625 | | | | 5/4/12 8:24 AM | | | 24.125 |
| 29 | 5/4/12 8:20 AM | | | 0 | 0 | | 5/4/12 9:36 AM | | | 72.5625 | 53 | | 5/4/12 8:24 AM | | | 24.125 |
| 30 | 5/4/12 8:20 AM | | | 0 | 0 | | 5/4/12 9:40 AM | 70.625 | 42.625 | | | | 5/4/12 8:25 AM | 0 | 0 | 24.125 |
| 31 | 5/4/12 8:21 AM | | | 0 | 0 | | 5/4/12 9:42 AM | | | 71.8125 | 53 | | 5/4/12 8:25 AM | | | 24.125 |
| 32 | 5/4/12 8:21 AM | | | 0 | 0 | | 5/4/12 9:45 AM | 70.625 | 43.125 | | | | 5/4/12 8:25 AM | | | 24.125 |
| 33 | 5/4/12 8:21 AM | | | 0 | 0 | | 5/4/12 9:48 AM | | | 71.375 | 53 | | 5/4/12 8:25 AM | | | 24.125 |
| 34 | 5/4/12 8:21 AM | | | 0 | 0 | | 5/4/12 9:50 AM | 70.625 | 45.125 | | | | 5/4/12 8:25 AM | | | 24.125 |
| 35 | 5/4/12 8:22 AM | | | 0 | 0 | | 5/4/12 9:54 AM | | | 71.0625 | 53 | | 5/4/12 8:25 AM | | | 24.125 |
| 36 | 5/4/12 8:22 AM | | | 0 | 0 | | 5/4/12 9:55 AM | 70.625 | 46.125 | | | | 5/4/12 8:25 AM | | | 24.125 |
| 37 | 5/4/12 8:22 AM | | | 0 | 0 | | 5/4/12 10:00 AM | 70.625 | 46.625 | 70.8125 | 53 | | 5/4/12 8:25 AM | | | 24.125 |
| 38 | 5/4/12 8:22 AM | | | 0 | 0 | | 5/4/12 10:05 AM | 70.625 | 46.625 | | | | 5/4/12 8:25 AM | | | 24.125 |
| 39 | 5/4/12 8:23 AM | | | 0 | 0 | | 5/4/12 10:06 AM | | | 70.625 | 53 | | 5/4/12 8:25 AM | | | 24.125 |
| 40 | 5/4/12 8:23 AM | | | 0 | 0 | | 5/4/12 10:10 AM | 70.625 | 46.625 | | | | 5/4/12 8:25 AM | | | 24.125 |
| 41 | 5/4/12 8:23 AM | | | 0 | 0 | | 5/4/12 10:12 AM | | | 70.4375 | 53 | | 5/4/12 8:25 AM | | | 24.125 |

FIG. 10

FIRE PREVENTION SYSTEMS AND METHODS

CROSS-REFERENCE TO RELATED PATENT APPLICATIONS

This application claims the benefit of U.S. Provisional Patent App. Ser. No. 61/650,940, filed May 23, 2012, incorporated herein by reference in its entirety.

BACKGROUND

The present disclosure generally relates to the field of fire prevention. The present disclosure relates more specifically to a fire prevention system that maintains a specific range of oxygen levels within an enclosed space to prevent fires.

SUMMARY

Embodiments relates to a system or method that prevents a fire from being started in an enclosure. A system or method that has an air distribution system configured to provide nitrogen into a room to reduce an oxygen concentration level within the room below a desired oxygen concentration level such that the atmosphere in the room fails to provide sufficient oxygen to sustain combustion.

Alternative exemplary embodiments relate to other features and combinations of features as may be generally recited in the claims. Embodiments described below allow parallel processing of each component. Parallel processing indicates that each component irrespective of the other components of the model may be sent to the solver or other modules. Implementations provide a user a level of detail and a level of abstraction display. The user may choose a level of detail and a level of abstraction to view.

BRIEF DESCRIPTION OF THE FIGURES

The disclosure will become more fully understood from the following detailed description, taken in conjunction with the accompanying figures, wherein like reference numerals refer to like elements, in which:

FIGS. 7-11 are example user interfaces of a program for monitoring functionality of the fire prevention system according to an exemplary embodiment.

DETAILED DESCRIPTION OF THE EXEMPLARY EMBODIMENTS

Figure 1:
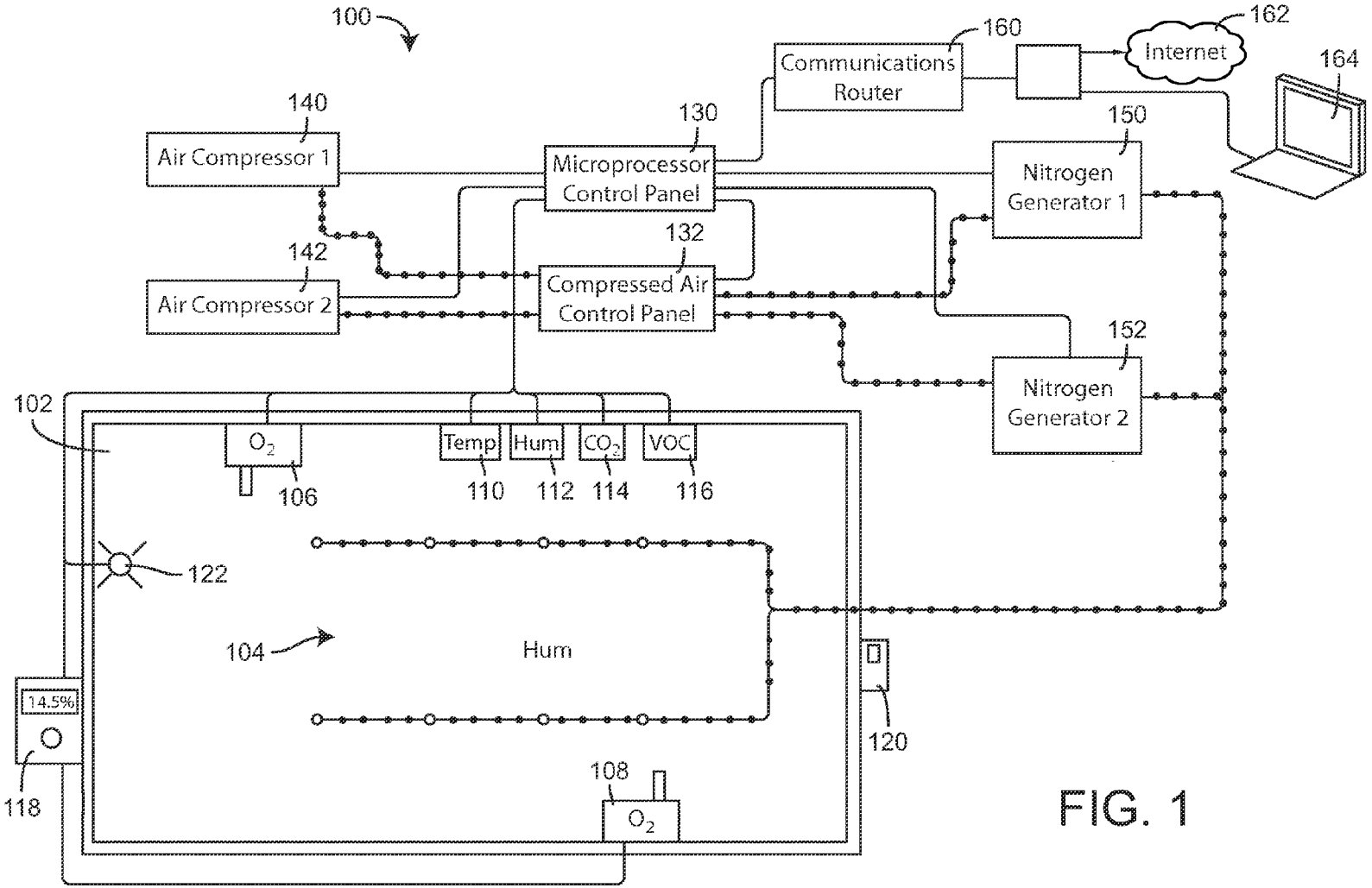
FIG. 1 is a block diagram of a fire prevention system, according to an exemplary embodiment.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring generally to the figures, a system and method for fire prevention in an enclosed space is shown and described. The fire prevention system may be configured to continuously maintain oxygen levels in an enclosed space below a level that supports combustion. The fire prevention system may simultaneously maintain oxygen levels above an acceptable level for which an authorized person can enter the enclosed space and work within the space. The fire prevention system may generally include multiple air compressors and nitrogen generators that may be used to control the oxygen levels in the enclosed space. The fire prevention system may generally include various sensors (e.g., $CO_2$, $O_2$, humidity, temperature) for monitoring the enclosed space, one or more displays (either local or remote) for displaying information related to the fire prevention system to a user, and one or more control panels including various sensors, valves, microprocessors, and other components for operating the fire prevention system.

The method for fire prevention in an enclosed space includes controlling the operation of the air compressors and nitrogen generators in the system. For example, a processing circuit of the fire prevention system may receive sensor input and determine if the oxygen levels in an enclosed space is satisfactory. If the oxygen level in the enclosed space exceeds a threshold (e.g., an oxygen level is approaching a level at which combustion is possible), then the processing circuit may be configured to control operation of the one or more air compressors and nitrogen generators in order to pump nitrogen into the enclosed space in order to lower oxygen levels. The processing circuit may then maintain a proper oxygen level in the enclosed space. In one embodiment, a desired oxygen level may be at 14.6% oxygen in the enclosed space (an oxygen level at which a fire cannot be started or sustained in the enclosed space); in other embodiments, the desired oxygen level may vary.

The fire prevention system of the present disclosure allows for proper control and monitoring of the components associated with the enclosed space and fire prevention system, as well as the enclosed space itself. The fire prevention system implements the delivery of air (nitrogen) into the enclosed space to control oxygen levels. Further, the fire prevention system improves calculations for key operational and design parameters. For example, rates such as an oxygen pull down rate (the rate at which the oxygen level is decreased) or pull down time (the time it takes to reduce an oxygen level to an acceptable level), enclosed space leakage rate (the rate at which air leaks out from the enclosed space), and transient recovery rate (the rate at which it takes the fire prevention system to go from idle to having an enclosed space with a preferred oxygen level) are factored in when determining fire prevention system functionality as described below. The use of the duplex system as described below (two air compressors and two nitrogen generators) allows for a more efficient fire prevention system, allows for faster pull down rates and increased reliability via redundancy, and improves the ability to maintain oxygen levels in the enclosed space. In other embodiments, the system may have four or more air compressors and four or more nitrogen generators. Further, the fire prevention system may be used to collect trend data (e.g., oxygen levels, temperature, humidity, etc.) to verify proper system installation, proper setup and operation of the system, improve reliability of the equipment, and to allow for selection of the best parameters to increase energy efficiency.

Figure 2:
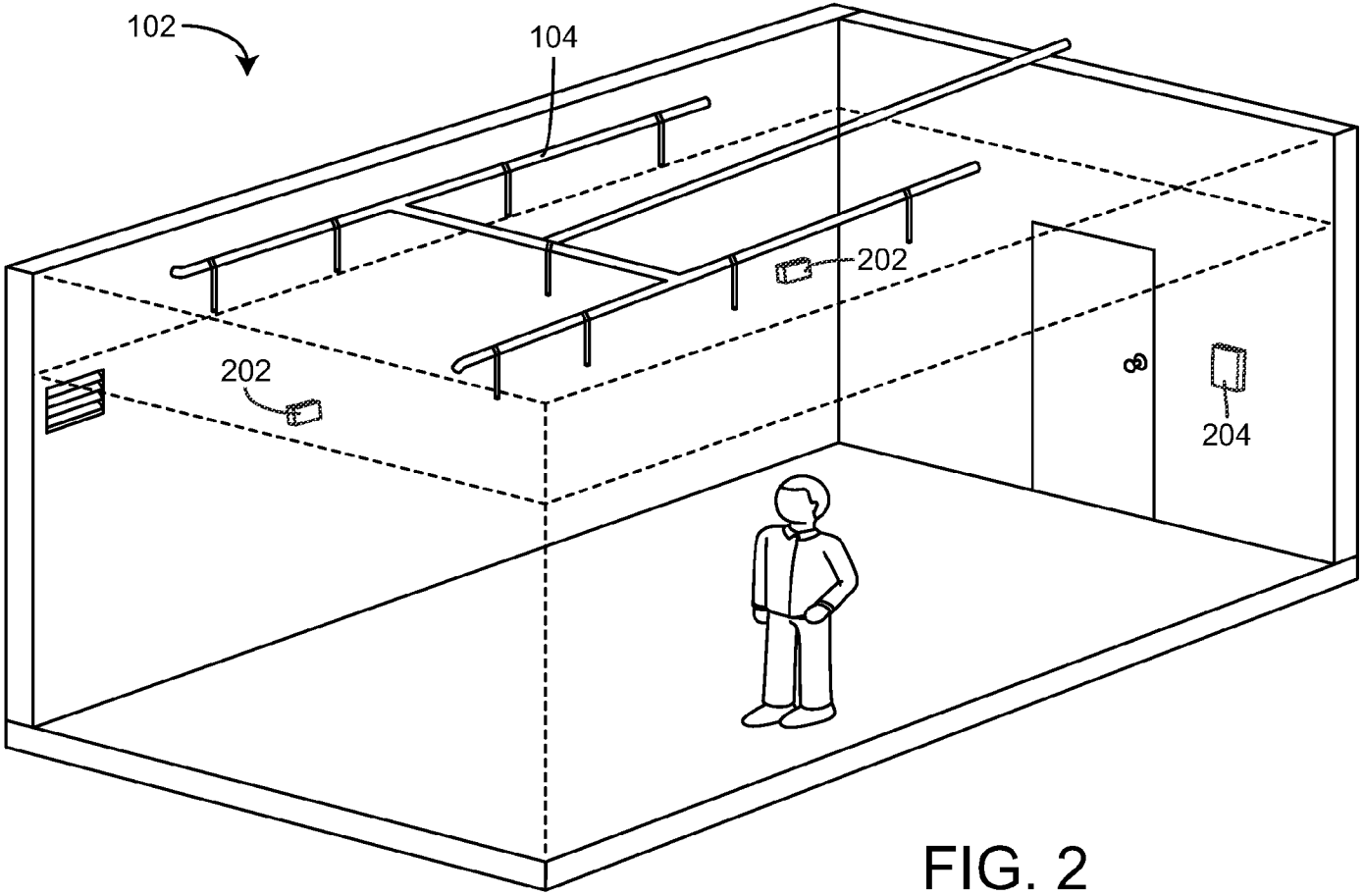
FIG. 2 is an environment view of an enclosed space in which the fire prevention system of the present disclosure may be implemented, according to an exemplary embodiment.

Referring now to FIG. 1, a block diagram of a fire prevention system 100 is shown, according to an exemplary embodiment. Fire prevention system 100 is shown to include a controlled space 102 (e.g., an enclosed space) including multiple sensors 106-116 and displays 118-122. For example, for controlled space 100, sensors such as oxygen sensor 106 or 108, temperature sensor 110, humidity sensor 112, $CO_2$ sensor 114, and volatile organic compound (VOC) sensor 116 may monitor controlled space 102 and be connected to a microprocessor control panel 130. Controlled space 102 may include any number of sensors or types of sensors. For example, controlled space 102 is shown to include two oxygen sensors 106, 108 at opposite ends of controlled space 102. Controlled space 102 may further include one or more displays 118, 120 that a user in controlled space 102 may view. Displays 116-122 may receive information from control panel 130 or sensors 106-116 to display to the user. Types of displays may include a monitor (e.g., as shown in display 118), an alarm light or other flashing display (e.g., display 122), or otherwise. Controlled space 102 is further shown to include a nitrogen distribution system 104. Nitrogen distribution system 104 may be a simply be a series of pipes and/or valves in or around controlled space 102 (e.g., in the ceiling above the space, in the floor below the space, or to the side of the controlled space). An example of a controlled or enclosed space 102 including sensors 202, displays 204, and a nitrogen distribution system 104 is shown in FIG. 2.

Fire prevention system 100 further includes a microprocessor control panel 130 configured to manage fire prevention system functionality. Control panel 130 may include a processing circuit (including a processor and memory) configured to control operation of air compressors 140, 142 and nitrogen generators 150, 152 (e.g., to control when the air compressors and nitrogen generators run, which valves to open to release the $N_2$ into the controlled space, etc.). Using input from sensors 106-116, control panel 130 may determine whether the oxygen level in controlled space 102 is satisfactory. If not, control panel 130 may determine which of air compressors 140, 142 and/or nitrogen generators 150, 152 should be running For example, if the oxygen levels increase beyond a given threshold, the resulting reading from oxygen sensor 106 may be provided to control panel 130, and control panel 130 may start operation of air compressor 140 and nitrogen generator 150. As another example, an increased VOC level in controlled space 102 may be used by control panel 130 to determine that the oxygen level in controlled space 102 should be reduced further. As another example, if air temperature sensor 112 indicates an increase in temperature, it may mean that problems exist within space 102. The pressure of air compressors 140, 142 may be monitored (ideal operation at 150 to 160 psi) and if the compressor temperature increases, the air compressor may fail.

Microprocessor control panel 130 may generally include a processing circuit including a processor and memory. The processor may be implemented as a general purpose processor, an application specific integrated circuit (ASIC), one or more field programmable gate arrays (FPGAs), a group of processing components, or other suitable electronic processing components. The memory is one or more devices (e.g., RAM, ROM, Flash memory, hard disk storage, etc.) for storing data and/or computer code for completing and/or facilitating the various processes described herein. The memory may be or include non-transient volatile memory or non-volatile memory. The memory may include data base components, object code components, script components, or any other type of information structure for supporting the various activities and information structures described herein. The memory may be communicably connected to the processor and includes computer code or instructions for executing one or more processes described herein.

Fire prevention system 100 further includes at least two air compressors 140, 142 and two nitrogen generators 150, 152. Each air compressor 140, 142 is shown paired with a corresponding nitrogen generator 150, 152. While the present disclosure illustrates fire prevention system 100 with two air compressors and two nitrogen generators (e.g., a duplex air compressor and duplex nitrogen generator), it should be understood that fire prevention system 100 may include any number (3, 4, 5, 6, 7, 8, 9, 10 or more) of air compressor and nitrogen generator pairs. In one embodiment, fire prevention system 100 may be configured such that each pair of air compressors and nitrogen generators (e.g., pairs 140, 150 and 142, 152) in the system may operate together. For example, the operation of the air compressors and nitrogen generators may alternate (only one air compressor and nitrogen generator operate at a given time (e.g. 1, 2, 3, 4 weeks), then switches to the other air compressor and nitrogen generator as needed). The duplex design of FIG. 1 allows for a better reliability and response of fire prevention system 100 (e.g., a faster pull down time, faster transit response, etc.).

Air compressors 140, 142 may be connected to a power source (e.g., a 3 phase power source or other source). Upon receiving a signal for activation from control panel 130, air compressors 140, 142 may begin functioning such that the corresponding nitrogen generator begins generating nitrogen to deliver into the enclosed space.

Fire prevention system 100 includes a compressed air control panel 132 connected to air compressors 140, 142 and nitrogen generators 150, 152. Compressed air control panel 132 may be configured to control the output of air compressors 140, 142 and the inputs to nitrogen generators 150, 152. Compressed air control panel 132 may be further connected to microprocessor control panel 130 and may receive instructions from microprocessor control panel 130 for managing air compressor output and nitrogen generator input. Compressed air control panel 132 may include one or more mechanical valves, flow sensors, and pressure devices to control air compressor and nitrogen generator functionality. For example, compressed air control panel 132 may include or be coupled to multiple valves. The valves may be slow opening valves that control the output of the air compressor to the nitrogen generator. Valve operation is shown in greater detail in FIG. 5.

Nitrogen generators 150, 152 may generate an air mixture to deliver into controlled space 102 through nitrogen distribution system 104. The air mixture delivered into controlled space 102 by nitrogen generators 150, 152 may be a mixture of nitrogen and other gases. For example, in one embodiment, nitrogen generators 150, 152 may provide a mixture of gases that includes approximately 95% nitrogen. Approximately 95% oxygen may include 93-96% oxygen.

When fire prevention system 100 is first initiated for a particular enclosed space 102, fire prevention system 100 may be configured to run both air compressors 140, 142 and nitrogen generators 150, 152 to displace oxygen in enclosed space faster 102. Then, when the oxygen level finally reaches the desired level (e.g., 14.1%-14.6%), fire prevention system 100 may then run normally, using a single air compressor and nitrogen generator to maintain the oxygen level. The operation of the air compressors and nitrogen generators are described in greater detail with reference to the processes of FIGS. 3-6.

Fire prevention system 100 further includes a remote monitor 164. Remote monitor 164 may be remotely connected to the other components of fire prevention system 100 (e.g., the microprocessor control panel, the individual sensors and displays, etc.). Remote monitor 164 may connect to microprocessor control panel 130 and other components via a communications router 160 and Internet 162, according to one embodiment. In various other embodiments, remote monitor 164 may have any type of wired or wireless connection with the rest of fire prevention system 100. Remote monitor 164 may display various information for a user of enclosed space 102 and fire prevention system 100 such as alarms, trend data, current operation, and other information. Examples of displays that remote monitor 164 may provide are shown in FIGS. 7-13. Remote monitor 164 and other components of fire prevention system 100 may further be connected to a remote processing circuit or other computer system configured to manage data provided by fire prevention system 100. For example, the computer system may receive alarm data and processes the alarm data for display on remote monitor 164 and/or send messages to appropriate service personnel. As another example, the computer system may receive trend data and store the trend data (e.g., data relating to oxygen levels, temperature levels, humidity levels, $CO_2$ levels, VOC levels, and other controlled space properties over a period of time).

In one embodiment, remote monitor 164 may be a laptop as shown in FIG. 1, a desktop, or another device having a wired connection with the rest of fire prevention system 100. In another embodiment, remote monitor 164 may be a mobile device, located remotely from the rest of fire prevention system 100. For example, remote monitor 164 may be a smartphone, other mobile phone, tablet, PDAs, or any other type of handheld device configured to communicate with fire prevention system 100 via a wireless (or wired) connection. Remote monitor 164 may include or be connected one or more input devices (e.g., keyboard, mouse, or monitor 164 may be a touchscreen) and output devices to receive and display data related to fire prevention system 100.

Referring to FIG. 2, an environment view of an enclosed space 102 in which fire prevention system 100 may be implemented is shown, according to an exemplary embodiment. Fire prevention system 100 may be implemented in any type of enclosed space in which the air of the space may be controlled. For example, fire prevention system 100 may be implemented in an enclosed space for computer systems and data processing, data storage and data transfer facilities; an enclosed space for operation of critical military or government systems; an enclosed space for storage of records, documents, high value items or high value military inventory; an enclosed space for prevention of ignition in small particle dust environment (explosion prevention) or otherwise. It should be appreciated that fire prevention system 100 disclosed herein may be implemented in any type of enclosed space.

In the embodiment of FIG. 2, multiple sensors 202 and displays 204 are shown throughout enclosed space 102. Enclosed space 102 may include any number of sensors (e.g., oxygen sensors for monitoring the oxygen levels in the enclosed space, temperature sensors, humidity sensors, CO2 sensors, VOC sensors, etc. as described with reference to FIG. 1). Sensors 202 are shown located on the walls of enclosed space 102; in various embodiments, sensors 202 may be located on the ceiling or floor, or may be located behind the walls or surface of enclosed space 102. Enclosed space 102 may also include one or more displays 204. Display 204 may show an oxygen level, fire prevention system status, or any other general enclosed space information. For example, display 204 may show an oxygen level, or may show information from sensors 202 in enclosed space 102. Display 204 may include or be connected to a alarm light or other light used to indicate any special condition in the space (e.g., if the oxygen level is too high or to low).

The various sensors may be used to detect a possible effect that room conditions may have on the operation of fire prevention system 100 and/or personnel and other equipment in the space. An increased VOC level, $CO_2$ level, humidity level, or temperature level may indicate that the effectiveness of fire prevention system 100 may be changed.

In the embodiment of FIG. 2, a nitrogen distribution system 104 is shown above enclosed space 102. In other embodiments, nitrogen distribution system 104 may be located anywhere around enclosed space 102 (e.g., floor, ceiling, walls). Nitrogen distribution system 104 may include any number of valves in which nitrogen may be released into the enclosed space, reducing the oxygen levels in enclosed space 102.

Referring generally to FIGS. 3-6, various flow chart of processes for fire prevention system operation are shown. While the processes of FIGS. 3-6 are shown executed consecutively in the figures, they may be executed either independent of each other or executed consecutively. The processes of FIGS. 3-6 may be executed by, for example, the microprocessor control panel of FIG. 1 or another control panel or processing circuit of the fire prevention system.

Figure 3:
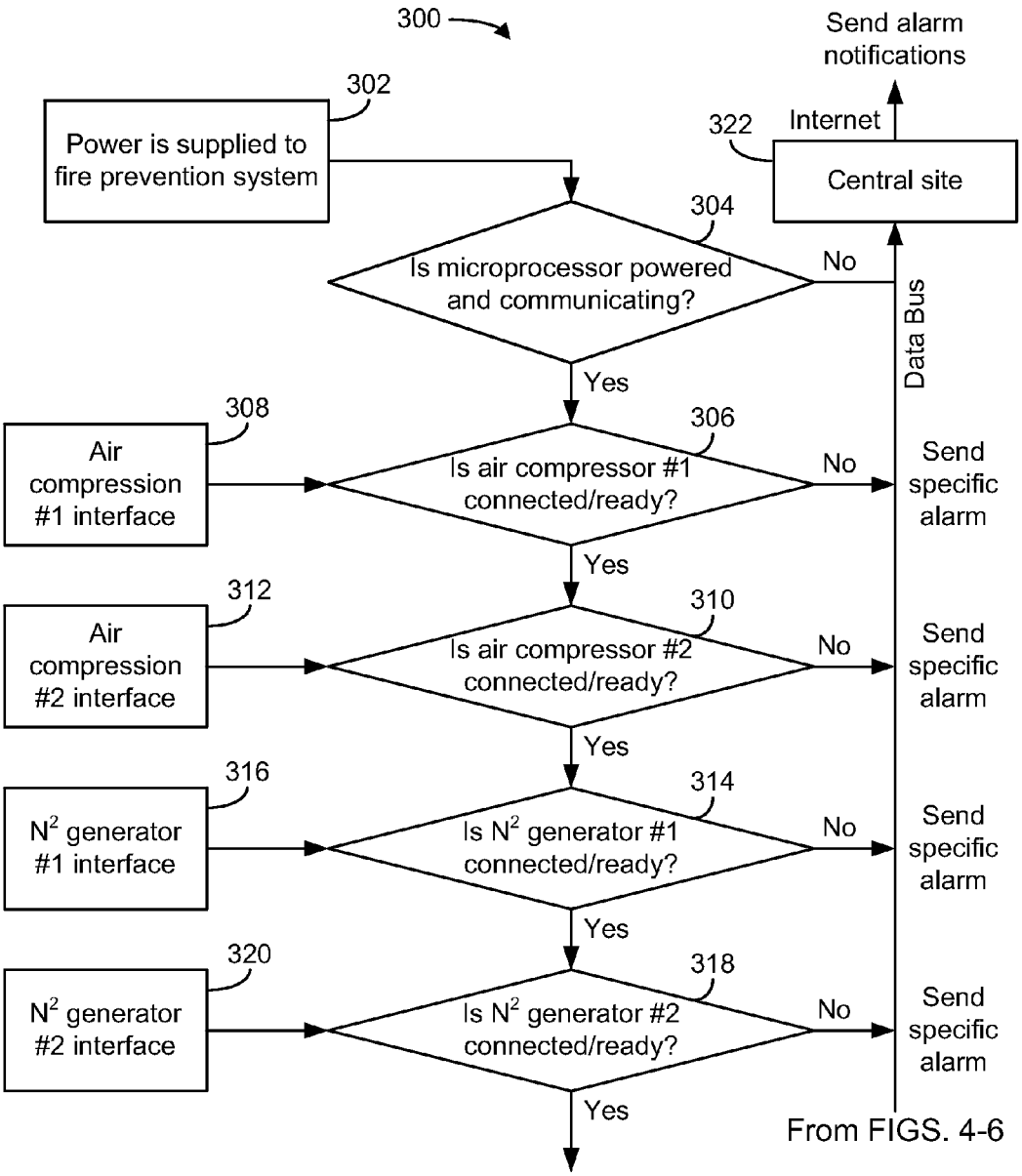
FIG. 3 is a flow chart of a process for performing a subsystem check of the fire prevention system, according to an exemplary embodiment.

Referring to FIG. 3, a flow chart of a process 300 for performing a subsystem check of the fire prevention system is shown. When power is supplied to the fire prevention system, activating the fire prevention system (block 302), connectivity and readiness of the various components may be checked. In other words, process 300 checks if the various components of the fire prevention system are connected and ready for operation, or if there are any possible malfunctions.

Process 300 includes first checking microprocessor control panel functionality (block 304). Process 300 further includes checking connectivity and readiness of each air compressor of the fire prevention system (blocks 306, 310). Process 300 includes receiving information from the interface of each air compressor (blocks 308, 312) in order to check the connectivity and readiness of each air compressor. If the air compressors are not functioning correctly (i.e., not connected to a nitrogen generator or not ready to function), a specific alarm may be sent to a central site (e.g., the remote monitor or remote computer system) via a data bus (block 322). Process 300 further includes checking connectivity and readiness of each nitrogen generator of the fire prevention system (blocks 314, 318). Process 300 includes receiving information from the interface of each nitrogen generator (blocks 316, 320) in order to check the connectivity and readiness of each nitrogen generator. If one or more nitrogen generators are not functioning correctly (i.e., not connected to an air compressor or not ready to pump nitrogen into an enclosed space), a specific alarm may be sent to a central site (e.g., the remote monitor or remote computer system) via a data bus (block 322) to alert corresponding maintenance and/or operations personnel.

Figure 4:
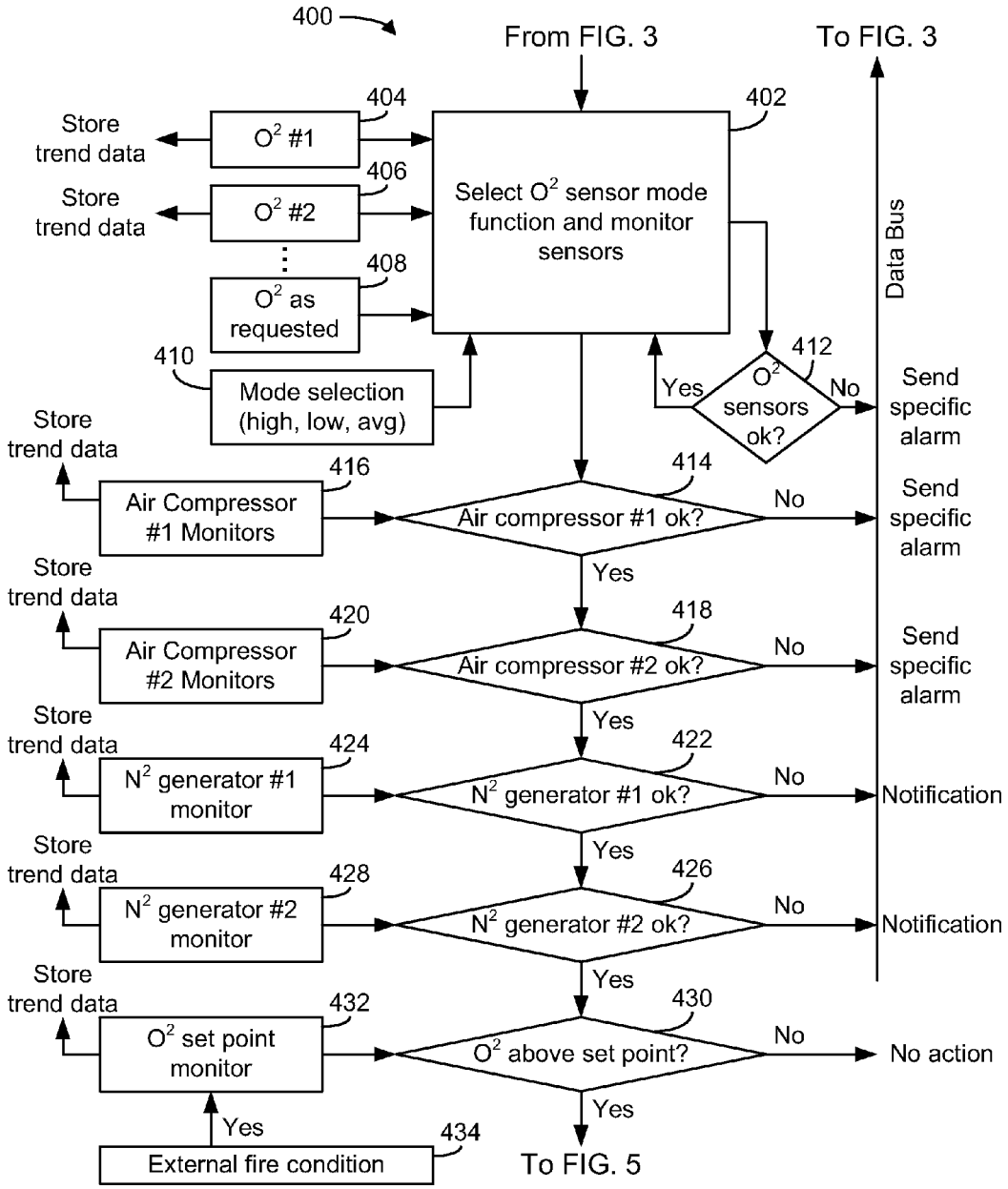
FIG. 4 is a flow chart of a process for checking sensor, air compressor, and nitrogen generator functionality of the fire prevention system, according to an exemplary embodiment.

Referring to FIG. 4, a flow chart of a process 400 for checking sensors, air compressors, and nitrogen generators of the fire prevention system for functionality is shown. Process 400 may be executed independently or after process 300 finishes checking connectivity and readiness of the various components of the fire prevention system. Process 400 including selecting an oxygen sensor mode function and monitoring the sensors (block 402). The oxygen sensors of the enclosed space may provide oxygen sensor readings for monitoring (blocks 404, 406, 408). The oxygen sensors may also be connected to a remote or local data store or other computing device for storing trend data relating to oxygen levels. In addition to receiving oxygen sensor data at block 402 from blocks 404, 406, 408, process 400 includes receiving a mode selection (e.g., high, low, average, etc.) (block 410). The mode selection relates to a desired oxygen level of the enclosed space.

Process includes checking functionality of the various sensors of the enclosed place (block 412). If a sensor is not functioning correctly, an alarm may be sent via the data bus to a central site to alert corresponding maintenance and/or operations personnel (block 322 of process 300). The determination of sensor functionality may be made based on sensor data, according to one embodiment (e.g., if the sensor data values are unrealistic, or inconsistent with previous sensor data, etc.).

Process 400 further includes checking air compressor functionality (blocks 414, 418). Process 400 may include receiving data from the air compressor monitors (blocks 416, 420) and determining air compressor functionality based on the data. Further, the data may be stored as trend data in a remote or local data store or other computing device. If one or more air compressors is not functioning correctly, an alarm may be sent via the data bus to a central site to alert corresponding maintenance and/or operations personnel (block 322 of process 300).

Process 400 further includes checking nitrogen generator functionality (blocks 422, 426). Process 400 may include receiving data from the nitrogen generator monitors (blocks 424, 428) and determining nitrogen generator functionality based on the data. Further, the data may be stored as trend data in a remote or local data storage or other computing device. If one or more nitrogen generators is not functioning correctly, an alarm or notification may be sent via the data bus to a central site to alert corresponding maintenance and/or operations personnel (block 322 of process 300).

After checking all functionality of the fire prevention system as shown in FIGS. 3-4, the oxygen level of the enclosed space may then be checked to determine if the oxygen levels are above a set point (block 430). If not, then the oxygen level in the enclosed space is low enough to prevent combustion. If the oxygen levels are above the set point, then the oxygen level needs to be lowered by the fire prevention system to prevent combustion.

Process 400 may include receiving data from an oxygen sensor (e.g., from an oxygen set point monitor) (block 432). The microprocessor control panel may be configured to determine an oxygen level of the enclosed space using an oxygen sensor. The microprocessor control panel may further be configured to detect an external fire condition (block 434). In other embodiments, other sensors of the enclosed space may be configured to detect an external fire condition or to receive an indication of the external fire condition using a fire alarm system. Upon an indication that there is an external fire condition (received at block 430 via the oxygen set point monitor at step 432), the fire prevention system increases the nitrogen output to reduce the oxygen level as much as possible. For example, the oxygen level set point may be reduced to 13.2% or less. The system may or may not reach the set point, but the oxygen level is reduced further so that the enclosed area is further protected from a threat of fire.

Figure 5:
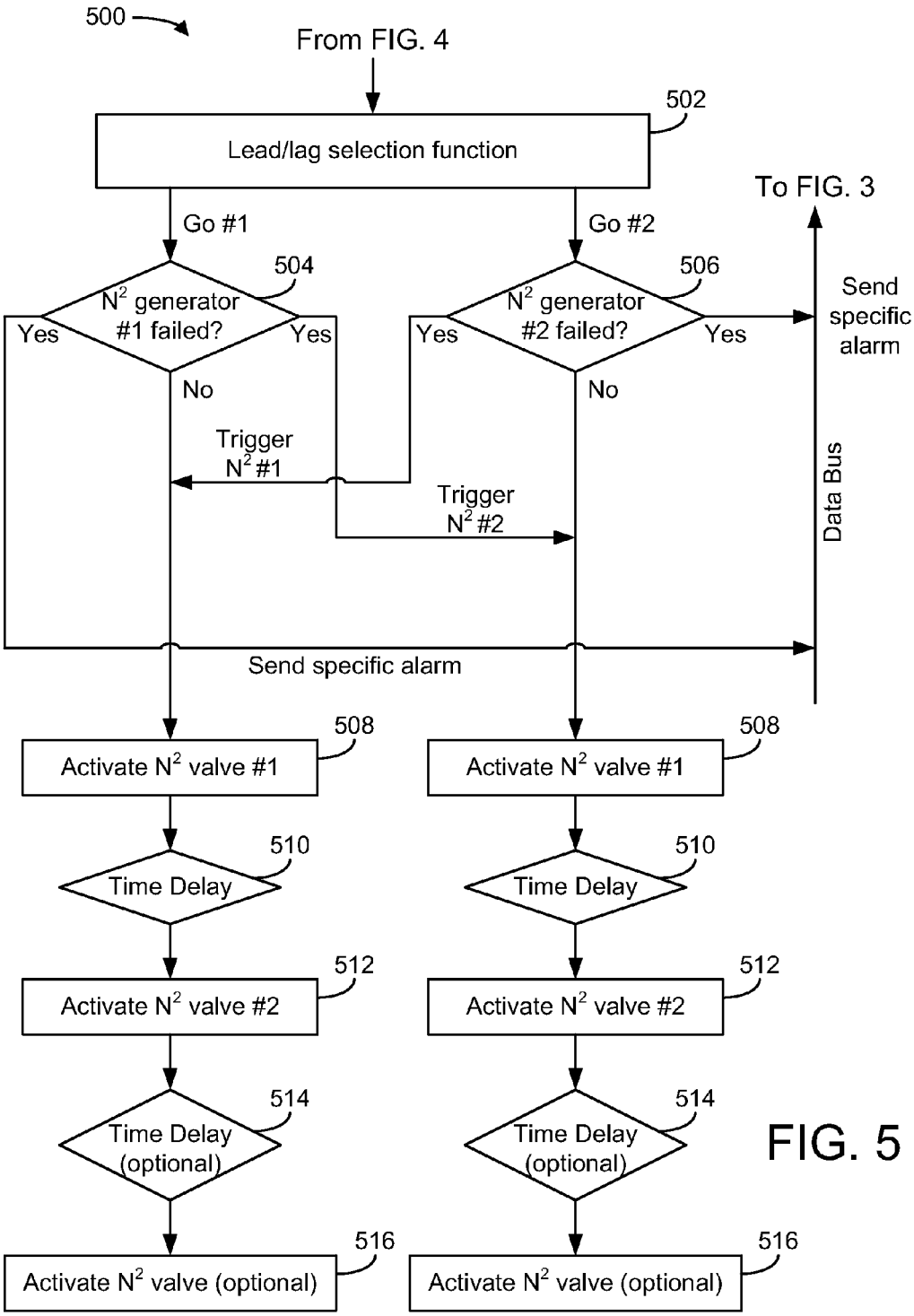
FIG. 5 is a flow chart of a process for a lead/lag selection function and nitrogen generator valve activation of the fire prevention system, according to an exemplary embodiment.

Referring now to FIG. 5, a flow chart of a process 500 for a lead/lag selection function and nitrogen generator valve activation of the fire prevention system is shown. The process of FIG. 5 may be executed upon a determination that an oxygen level of the enclosed space is too high (e.g., at block 430 of process 400. Process 500 includes the implementation of the lead/lag selection function (block 502). The selection of the lead/lag system may generally include alternating between air compressors and nitrogen generators sets (e.g., alternating between the two air compressor/nitrogen generator sets $N^2$ generator #1 and $N^2$ generator #2 by activating the first nitrogen generator and not the second). The "lag" may be activated as well (e.g., activating both air compressor nitrogen generator sets) if the pull down time or rate is below the target setting. The pull down time relates to an estimated time that it would take a nitrogen generator to lower the oxygen level in an enclosed space to an acceptable level. If the pull down time is higher than a given threshold, then both air compressor/nitrogen generator sets may be used. Both the "lead" and "lag" may be activated if it is determined that both air compressor/nitrogen generators are need to run.

In an exemplary embodiment, if the pull down time is below the acceptable threshold, one of the air compressor/nitrogen generator sets run, delivering nitrogen into the enclosed space to reduce the oxygen level, while the other air compressor/nitrogen generator set remains idle. If the air compressor/nitrogen generator set currently running fails (blocks 504, 506), then another air compressor/nitrogen generator may be triggered. The switching between air compressors and nitrogen generators may further be done based on a scheduled interval (e.g., switching every 168 hours) or based on current conditions of the enclosed space or components of the fire prevention system.

When one of the air compressor/nitrogen generators is activated, a first valve of the air compressor/nitrogen generator may be activated (block 508). The valve may be a valve configured to control air compressor output. The valve may be a slow opening valve. Then, after a set time delay (block 510), the next valve of the nitrogen generator may be activated (block 512). This process may continue (e.g., blocks 514, 516) until all of the valves of the nitrogen generator are activated. In one embodiment, the second valve may be larger than the first valve and may allow greater air flow when it is open. Further, the valves may be staged. The use of the valves allows the fire prevention system to control the process of gradually bringing up the air pressure. This allows for a more controlled and steady process of lowering the oxygen level in the enclosed space.

Figure 6:
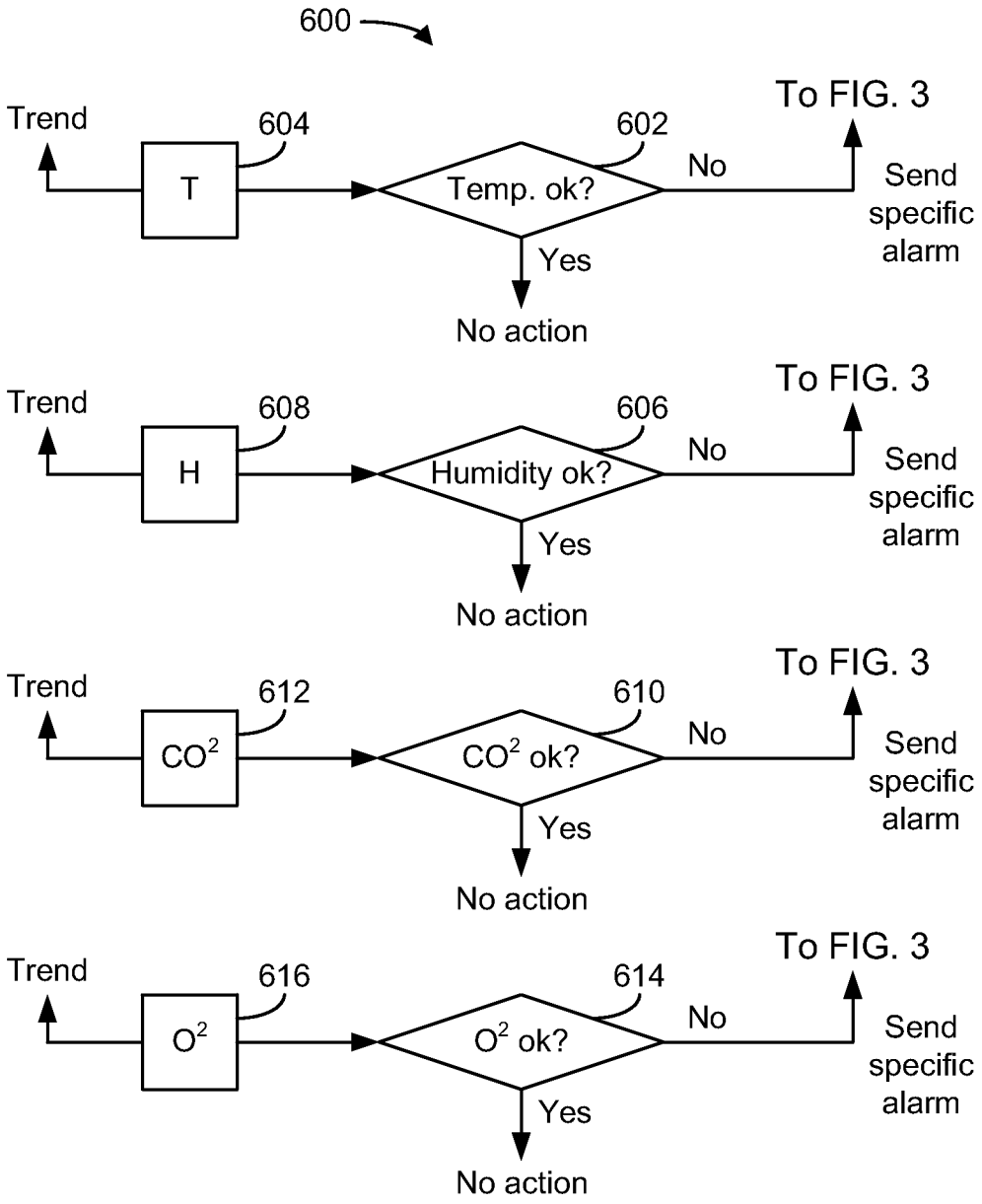
FIG. 6 is a flow chart of a process for monitoring various levels of the fire prevention system, according to an exemplary embodiment.

Referring now to FIG. 6, a flow chart of processes 600 for monitoring various levels of the fire prevention system is shown. Processes 600 may be executed to check various sensor readings. Processes 600 may be executed in parallel with processes 300, 400, and 500, or may be executed independently of any of the other processes. The Processes 600 includes checking the temperature of the enclosed space (block 602) via the temperature sensor reading (block 604). If the temperature is within a threshold value or range, an alarm may be provided to the central site. Further, temperature data may be stored remotely or locally. The same steps may be taken for the humidity level and humidity sensor (blocks 606, 608), $CO_2$ levels and $CO_2$ sensor (blocks 610, 612), and VOC levels and VOC sensor (blocks 614, 616).

Referring generally to FIGS. 3-6, the alarms or notifications provided when a particular component is not functioning or an oxygen or other level is too low or high may be used by the remote computer or other computing device at the central site. A system interface may be connected to the central site and used as the interface for the fire prevention system. This system interface may be used to initiate a default sequence. The default sequence may be an automatic reaction to the alarm or notification of appropriate maintenance and or operations personnel. For example, when the oxygen level is too high, the default sequence may be used to activate the air compressors and nitrogen generators to reduce the oxygen level in the enclosed space. This default sequence may be executed at the remote computer, microprocessor control panel, or other computing device connected to the fire prevention system. Further, user interfaces such as the user interfaces of FIGS. 7-13 below may be created to display such information as needed.

Referring now to FIGS. 7-13, example user interfaces of a program for monitoring functionality of the fire prevention system are shown. The user interfaces of FIGS. 7-13 are examples of displays that may be provided to a user monitoring the fire prevention system. The displays may generally include information such as the current status of the fire prevention system, various sensor readings (e.g., a temperature level, humidity level, etc.), operation of the air compressors and nitrogen generators, the oxygen level, and other information. Using the user interfaces of FIGS. 7-13, a user may monitor the performance and operation of the fire prevention system, analyze the fire prevention system or enclosed space properties, or otherwise. For the graphs of FIGS. 7-9, assume that the fire prevention system remains idle prior to system STARTUP until about 3:00 PM; then the fire prevention system begins operation.

Figure 7:
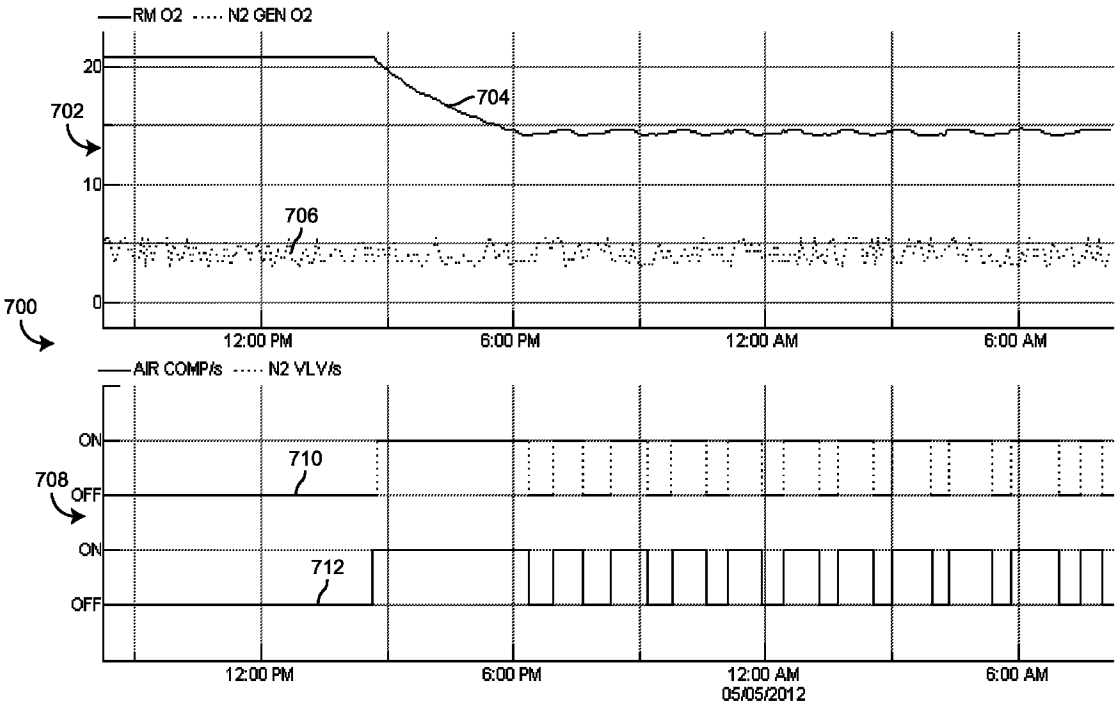

Referring now to FIG. 7, a user interface 700 displaying nitrogen generator operation is shown. In top graph 702, the room oxygen level 704 is shown compared to the nitrogen generator oxygen level 706. In an exemplary embodiment, the nitrogen generator may produce 5% oxygen (and 95% nitrogen) out of the total air generated. In graph 702, nitrogen generator oxygen level 706 is shown as being consistently about 5%. Therefore, the graph 702 illustrates proper functionality of the nitrogen generator Room oxygen level 704 is shown starting around 21%, which is above the desired threshold. As the nitrogen generator is activated at about 3:00 PM, room oxygen level 704 is shown decreasing to approximately 14.6%, and then maintained at the 14.6% level over time. Approximately 14.6 can include anywhere from 13.5 to 15%.

In bottom graph 708, air compressor operation 710 and nitrogen generator valve operation 712 are graphed. Both start in the off position until the fire prevention systems initiates. Then both the air compressor activates and the nitrogen generator valves are opened until the oxygen levels in the room reach the desired level. The air compressor and nitrogen generator valves then switch in between the on and off position as the nitrogen generator is activated and deactivated to maintain the desired oxygen level at 14.6%. For example, the enclosed space may be in a transient state (e.g., the oxygen level may not stay at 14.6% once it is reached). Therefore, the fire prevention system may continue to operate by continually turning on and off air compressor operation 710 and nitrogen generator valve operation 712 as needed to maintain the oxygen level. The fire prevention system may do this based on a pre-set schedule (e.g., every 20 or 30 minutes) or may simply run when the oxygen level reaches a threshold. In another embodiment, the on and off $O_2$ set points are adjusted to optimize the efficiency and reliability of the air compressor operation. The system may operate at less than full output capacity to maintain higher system efficiency.

Figure 8:
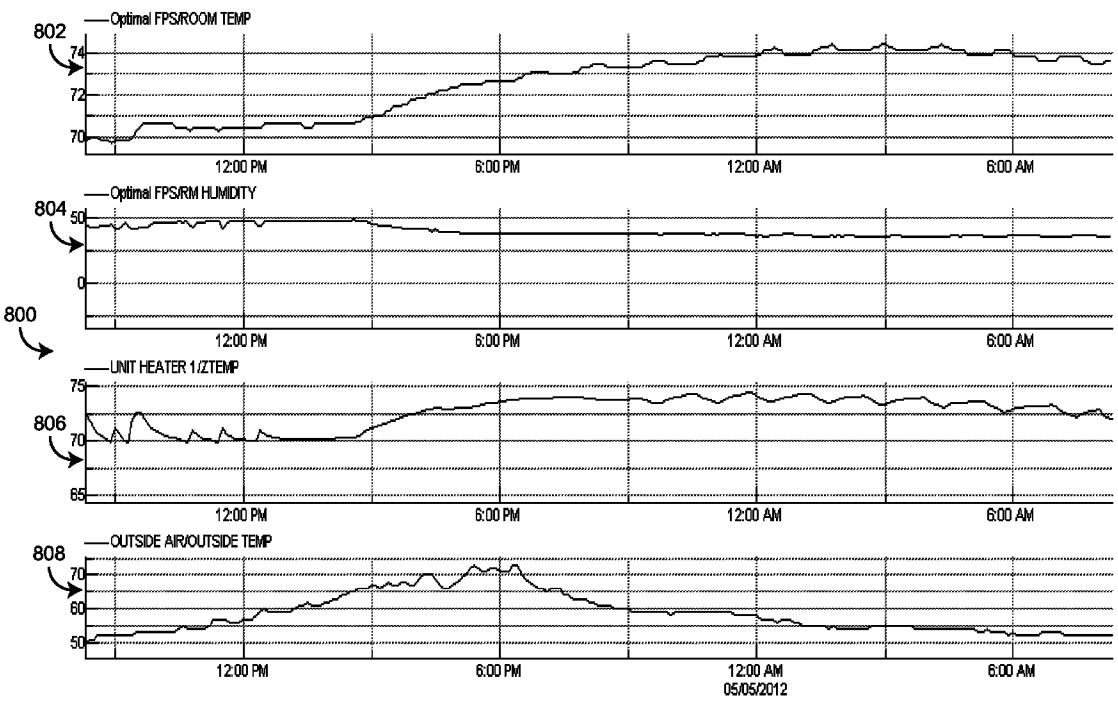

Referring now to FIG. 8, another user interface 800 is shown. The four graphs 802, 804, 806, 808 illustrate a room temperature, humidity, heater temperature, and outside temperature (temperature outside the enclosed space), respectively. When the fire prevention system is initiated at 3:00 PM, the room temperature (graph 802) rises as the nitrogen generator is activated. The humidity in the enclosed space is shown decreasing (graph 804). The exterior space temperature (ZTEMP) is shown increasing (graph 806). The outside temperature is shown naturally increasing and decreasing based on outside conditions (graph 808). The fire prevention system interprets this data by providing additional information for optimizing system operation.

Figure 9:
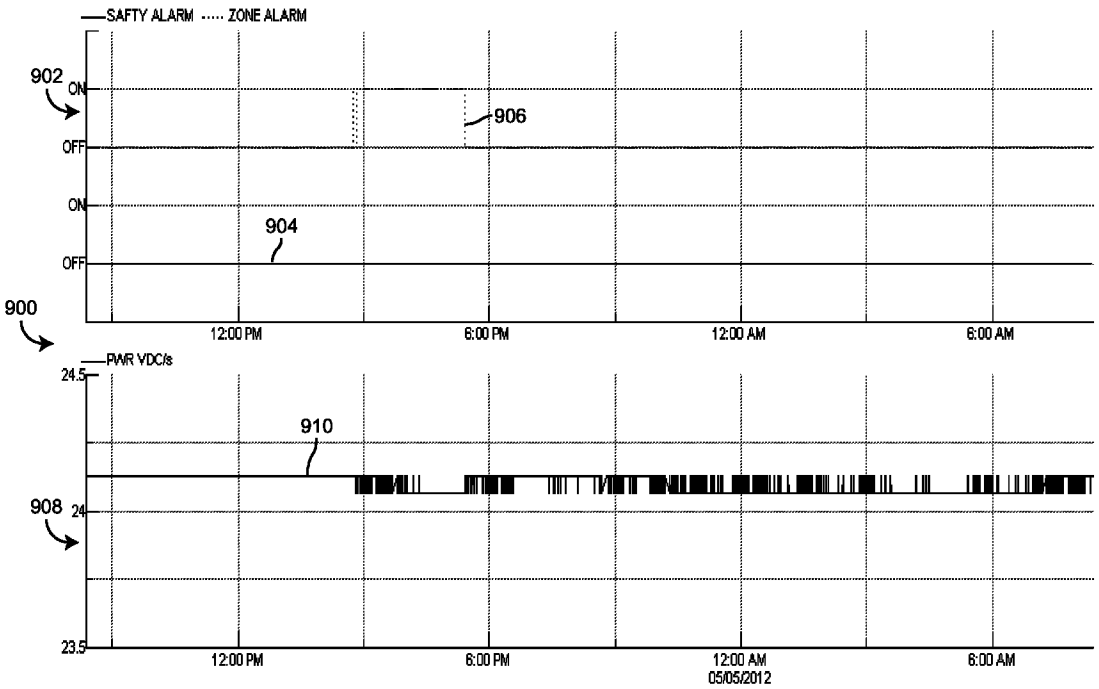

Referring now to FIG. 9, another user interface 900 is shown. Top graph 902 illustrates the position of two alarms, a safety alarm position 904 and a zone alarm position 906. Safety alarm ($O_2$ level below personnel safe level) position 904 is shown in the off position for the duration of the activity. Zone alarm position 906 is shown as activated from approximately 3:00 PM to 6:00 PM, which corresponds with the time the oxygen level decreases from about 21% to about 14.6%. The zone alarm is shown as activated when the condition of the oxygen level being too high for acceptable fire prevention is detected by the fire prevention system.

Bottom graph 908 illustrates the DC power supply voltage 910 provided to the fire prevention system controls. Power supply level 910 is used for the reliability of the functioning of the sensor and control devices.

The data shown in FIGS. 7-9 may be provided to the user in various formats. For example, in user interface 1000 of FIG. 10, the data may be provided in table form as shown, allowing a user to view the values. For example, the user may view oxygen levels, nitrogen generator oxygen levels, air compressor and nitrogen generator settings; the user may view sensor readings for the temperature, humidity, zone temperature, and outside temperature; and the user may view alarm information and power supply information. All of the data may be provided in a single table or across multiple tables, according to various exemplary embodiments.

Figure 11:
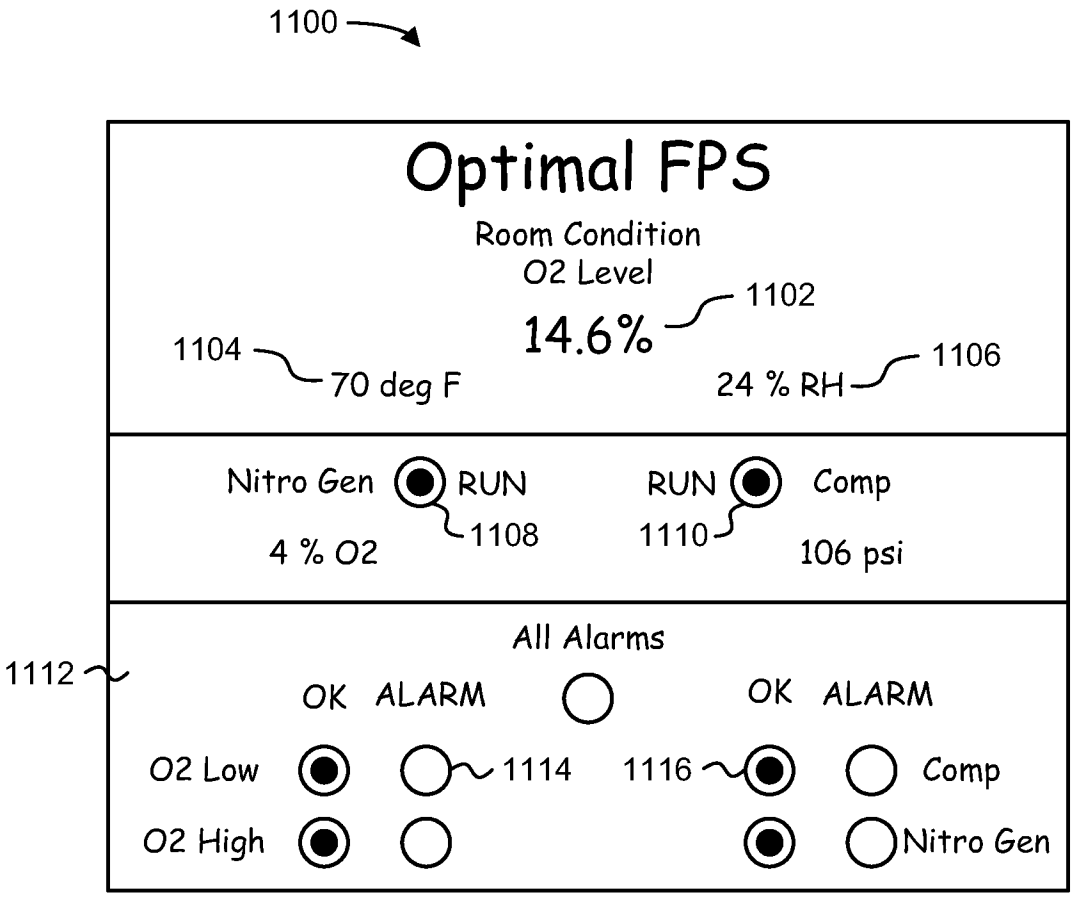

Referring now to FIG. 11, an example display 1100 is shown that provides an overview of the fire prevention system. Display 1100 provides the current oxygen level 1102 (14.6%) in the room or enclosed space. Display 1100 also shows the current temperature 1104 (70° F.) of the room and the relative humidity 1106 (24%) of the room.

Further, display 1100 may show if a nitrogen generator or air compressor is currently running using fields 1108, 1110. Further, display 1100 may show alarm-related information. For example, at the bottom 1112 of the display, if the oxygen is too high or low, or if there is an error with air compressor or nitrogen generator operation, a red light (or other indication) may be shown in the appropriate field (e.g., field 1114). Otherwise, a green light (or other indication) may be shown in the appropriate field (e.g., field 1116). In addition, a general alarm light may be provided that lights up when there is any alarm related to fire prevention system functionality. It should be understood that the type of information in the display of FIG. 11 may vary, according to various user settings or fire prevention system settings.

Figure 12:
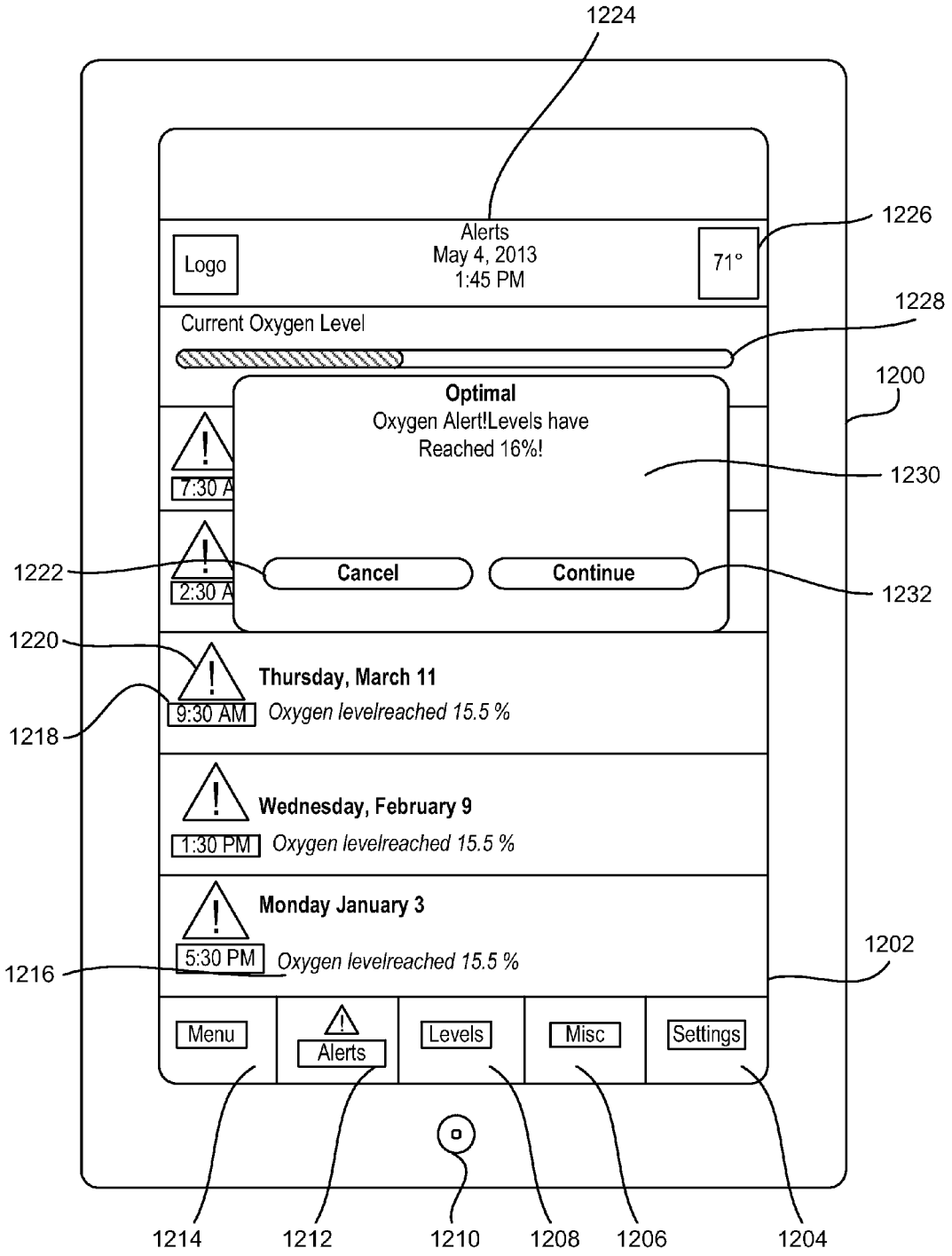
FIGS. 12-13 are example user interfaces of a program for monitoring functionality of the fire prevention system, as provided on a mobile device, according to an exemplary embodiment.
Figure 13:
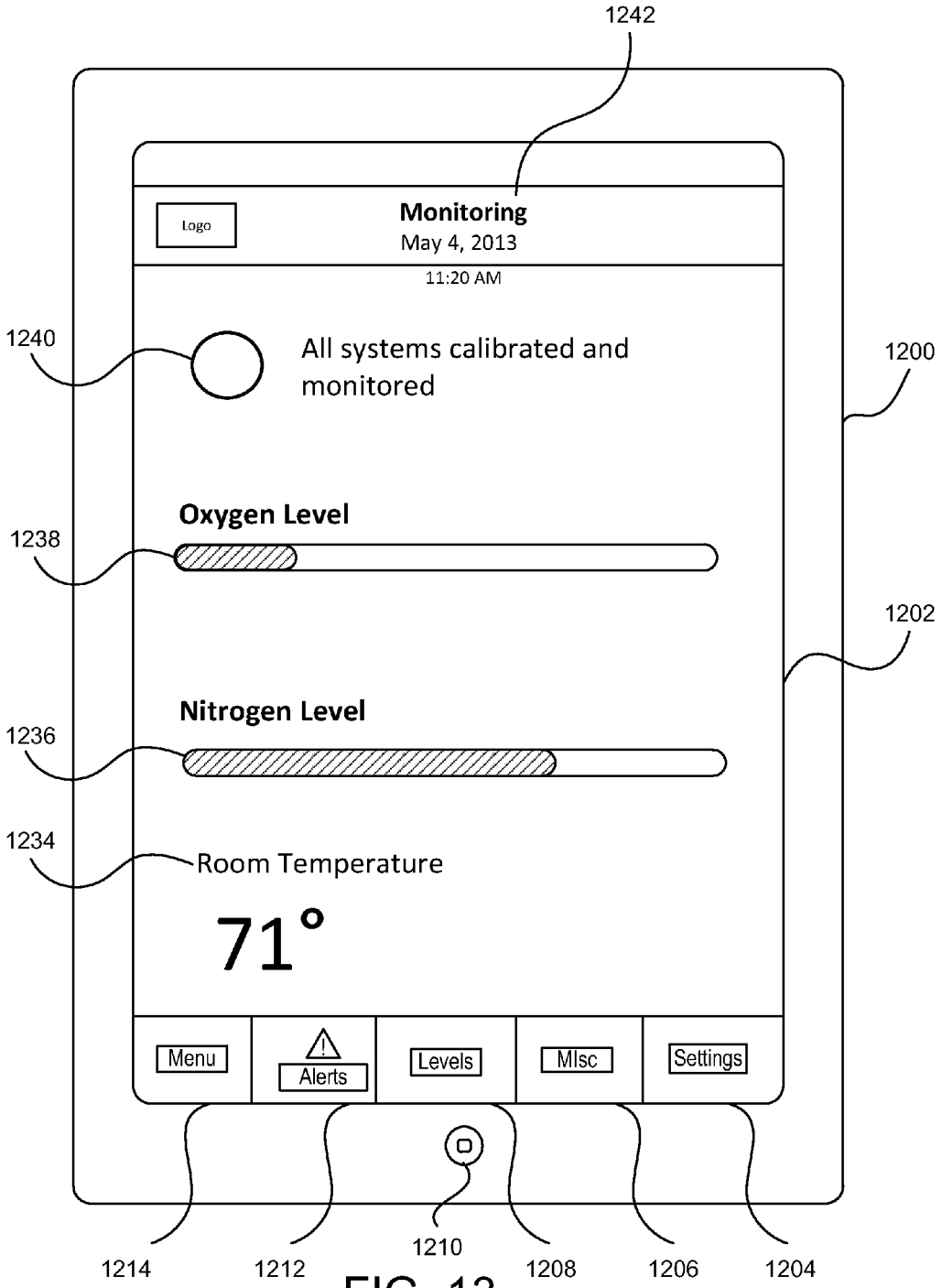

Referring generally to FIGS. 12-13, a user interface 1202 is shown and described that may be provided on a mobile device 1200 of a user. User interface 1202 may be provided to a user of mobile device 1200 responsible for monitoring any aspect of fire prevention system 100. In one embodiment, when an alert is generated by fire prevention system 100, system 100 may be configured to alert the user via user interface 1202. In another embodiment, a user may access user interface 1202 from mobile device 1200 at any time to view a current status, recent updates, etc.

Referring to FIG. 12, user interface 1202 includes various menu options 1204, 1206, 1208, 1212, 1214 that allow a user to view different aspects of the fire prevention system. By selecting option 1204, the user may view or edit settings related to the fire prevention system (e.g., how a user wishes to be alerted by system 100 when an unsafe oxygen level is detected). By selecting option 1206, the user may select one or more aspects of the fire prevention system 100. By selecting option 1208, the user may view current oxygen levels and nitrogen levels in one or more areas (shown in greater detail in FIG. 13). By selecting option 1214, the user may view a menu for the application running on mobile device 1200. The menu may include various general options such as closing the application, requesting updates, etc.

By selecting option 1212, the user may view recent alerts generated by the fire prevention system. In FIG. 12, user interface 1202 is shown to display a list of recent alerts. The display may include a top portion 1224 indicating the current date and time, and a current temperature 1226 of the one or more areas the alerts relate to. The display further includes a graphical representation of the current oxygen level 1228 in the one or more areas.

The list of recent alerts for the one or more areas may include a description 1216 of the alert (e.g., "Oxygen level reached 15.5%"). Description 1216 may describe the reason the alert was generated (e.g., if the oxygen level was too high, if there is an error with any functionality of the fire prevention system, etc.) A date and time 1218 of the alert may also be displayed. Date and time 1218 may represent the date and time at which the oxygen level reached a threshold value and was detected by the fire prevention system, the date and time at which the alert was sent, etc. A symbol 1220 may also be displayed for each alert entry. Symbol 1220 may graphically represent a type of alert. For example, symbol 1220 is shown as an exclamation point, indicating a high oxygen level. Symbol 1220 may be of any shape, and of any color or shading, to indicate different oxygen levels or other errors associated with the fire prevention system.

In the embodiment of FIG. 12, a pop-up screen 1230 is shown. When a high oxygen level (or other alert) is sent to mobile device 1200, user interface 1202 may be configured to generate pop-up screen 1230 to alert the user. The user may be provided with a cancel button 1222 that allows the user to ignore the alert. The user may also be provided with a continue button 1232 that allows the user to acknowledge the alert. Upon selecting button 1232, the user may be taken to another screen in order to address the alert (e.g., to send a command to the fire prevention system to reduce the oxygen level, to change other fire prevention system settings, etc.).

Referring now to FIG. 13, top portion 1242 indicates that the user is monitoring one or more oxygen levels and nitrogen levels of one or more areas of the fire prevention system. User interface 1202 includes an indicator 1240 and accompanying text. Indicator 1240 may indicate to the user whether there is an alert or other situation with the fire prevention system. For example, indicator 1240 may be green under normal operation, and red when an alert is received. Indicator 1240 may be accompanied by text that further describes a current status of the fire prevention system.

User interface 1202 further includes a display of an oxygen level 1238 and nitrogen level 1236 of an area User interface 1202 further includes a display indicating the current temperature 1234 of an area. User interface 1202 may further include other sensor data relating to an area, which may be provided by any number of sensors such as sensors 106-116 described in FIG. 1.

The fire prevention system of the present disclosure is shown to include various sensors and other components for completing the processes described herein. In various other embodiments, less or more sensors may be used, non-system checking software may be used, or continuous monitoring may be used without departing from the scope of the present disclosure.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A system for fire prevention, comprising:

an air distribution system configured to provide nitrogen into a room to reduce an oxygen concentration level within the room below a desired oxygen concentration level such that the atmosphere in the room fails to provide sufficient oxygen to sustain combustion;

the air distribution system comprising a first Nitrogen generator configured to operate during a first period of time and a second Nitrogen generator system configured to operate at a second period of time that is different than the first period of time;

the air distribution system comprising a compressed air control panel configured to control an output of a first and second air compressor and the inputs to the first and the second nitrogen generators; and the first nitrogen generator and the second nitrogen generator configured to operate in an alternating manner after a selected operating time period has expired in a lead-lag sequence to provide nitrogen after reaching the desired oxygen concentration level.

2. The system of claim 1, wherein the air distribution system ceases to provide nitrogen into the room when the oxygen concentration level is at or below the desired oxygen concentration level.

3. The system of claim 2, wherein the air distribution system begins providing nitrogen into the room upon detecting that the oxygen concentration level within the room is higher than the desired oxygen concentration level.

4. The system of claim 1, wherein the desired oxygen concentration level is 14.1% to 14.6% of the atmosphere within the room.

5. The system of claim 1, further comprising a sensor located within the room and configured to detect the oxygen level within the room.

6. The system of claim 1, further comprising at least two sensors for detecting oxygen and the at least two sensors may be placed at two nonadjacent walls or the same side of the room.

7. The system of claim 6, further comprising a controller configured to control the air distribution system based on an average or the lowest or the highest of the detected oxygen levels by the at least two sensors after removing from the calculation of any defective sensors.

8. The system of claim 1, further comprising sensors for monitoring the performance of the first nitrogen generator and sensors for monitoring the performance of the second nitrogen generator; and responsive to detecting a failure in the first air compressor, activating the second air compressor.

9. A system comprising:

a first air compressor configured to provide compressed air to a first nitrogen generator;

a second air compressor configured to provide compressed air to a second nitrogen generator; and the first and second nitrogen generators configured to provide nitrogen to a room until a desired oxygen concentration level is reached in the room;

the first Nitrogen generator configured to operate during a first period of time and a second Nitrogen generator system configured to operate at a second period of time that is different than the first period of time;

the air distribution system comprising a compressed air control panel configured to control an output of a first and second air compressor and the inputs to the first and the second nitrogen generators;

the first nitrogen generator and the second nitrogen generator configured to operate in an alternating manner after a selected operating time period has expired in a lead-lag sequence to provide nitrogen after reaching the desired oxygen concentration level.

10. The system of claim 9, wherein the desired oxygen concentration level is 14.1% to 14.6% as required by the type of material to be protected, of the atmosphere within the room.

11. The system of claim 1, further comprising at least two sensors for detecting oxygen and the at least two sensors may be placed at two nonadjacent walls or the same side of the room.

12. The system of claim 1, further comprising at least two sensors for detecting oxygen and the at least two sensors placed to be at two nonadjacent walls of the room.

13. The system of claim 12, further comprising a controller configured to control the air distribution system based on an average or the lowest or the highest of the detected oxygen levels by the at least two sensors after removal from the calculation of any defective sensors.

14. A method, comprising:

measuring a percentage oxygen in a room using at least two sensors located within the room;

adjusting the percentage of oxygen within the room by infusing a high percentage of Nitrogen into the room, using a Nitrogen generator system, such that the Nitrogen displaces the oxygen within the room;

wherein the Nitrogen generator system comprising a first Nitrogen generator and a second Nitrogen generator;

infusing a high percentage of Nitrogen into the room using the first Nitrogen generator system during a first period of time; and infusing a high percentage of Nitrogen into the room using the second Nitrogen generator system during a second period of time that is different than the first period of time;

controlling inputs to the first and the second nitrogen generators and outputs from the first and second compressors using a compressed air control panel;

operating the first Nitrogen generator and the second Nitrogen generator in an alternating manner after a selected operating time period has expired in a lead-lag sequence to provide nitrogen after reaching the desired oxygen concentration level.

15. The method of claim 14, wherein the desired percentage of oxygen is approximately between 95% and 96% by volume.

16. The method of claim 14, wherein the high percentage of Nitrogen is approximately between 14.1% and 14.4% by volume.

17. The system of claim 1, wherein the first period of time is at least 168 hours.

18. The system of claim 1, wherein the first Nitrogen generator is idle during the second time period.

19. The system of claim 1, wherein the compressed air control panel receives the output from the first and second air compressor; and wherein the compressed air control panel outputs the compressed air from the first and second air compressor to the first and second nitrogen generator.

20. The system of claim 1, wherein the first period of time and the second period of time are prescheduled to be about 168 hours.

21. The system of claim 1, wherein the first period of time and the second period of time are prescheduled to be one of 1 week, 2 weeks, 3 weeks or 4 weeks.

* * * * *